US008425021B2

(12) United States Patent
Chung et al.

(10) Patent No.: US 8,425,021 B2
(45) Date of Patent: Apr. 23, 2013

(54) INK CARTRIDGE FOR PRINTER

(75) Inventors: Kwang-Choon Chung, Yongin-si (KR); Chang Soo Yu, Suwon-si (KR); Nam Boo Cho, Anyang-si (KR); Young Chul Shin, Suwon-si (KR); Baek Song Heo, Ansan-si (KR); In-Ha Kim, Gunpo-si (KR); Jae-Won Choi, Gunpo-si (KR)

(73) Assignee: Inktec Co., Ltd., Kyungki-do (KR)

( * ) Notice: Subject to any disclaimer, the term of this patent is extended or adjusted under 35 U.S.C. 154(b) by 995 days.

(21) Appl. No.: 12/093,812

(22) PCT Filed: Mar. 28, 2007

(86) PCT No.: PCT/KR2007/001512
§ 371 (c)(1),
(2), (4) Date: May 15, 2008

(87) PCT Pub. No.: WO2007/111475
PCT Pub. Date: Oct. 4, 2007

(65) Prior Publication Data

US 2008/0284832 A1 Nov. 20, 2008

(30) Foreign Application Priority Data

Mar. 28, 2006 (KR) ..... 10-2006-0028147
Oct. 11, 2006 (KR) ..... 10-2006-0098833

(51) Int. Cl.
*B41J 2/17* (2006.01)
*B41J 2/175* (2006.01)

(52) U.S. Cl.
USPC ..... 347/86; 347/84

(58) Field of Classification Search ..... 347/86
See application file for complete search history.

(56) References Cited

U.S. PATENT DOCUMENTS

| | | | | |
|---|---|---|---|---|
| 6,817,707 | B1 | 11/2004 | Fowler et al. | |
| 2003/0107626 | A1 * | 6/2003 | Qingguo et al. | 347/86 |
| 2005/0146581 | A1 * | 7/2005 | Miyazawa et al. | 347/86 |
| 2005/0288874 | A1 * | 12/2005 | Qingguo et al. | 702/45 |
| 2007/0222840 | A1 * | 9/2007 | Xiao et al. | 347/86 |

FOREIGN PATENT DOCUMENTS

| | | | |
|---|---|---|---|
| JP | 2004-203059 | A | 7/2004 |
| JP | 2005-067173 | A | 3/2005 |
| JP | 2005-125635 | A | 5/2005 |

* cited by examiner

*Primary Examiner* — Matthew Luu
*Assistant Examiner* — Renee I Wilson
(74) *Attorney, Agent, or Firm* — The Webb Law Firm

(57) ABSTRACT

Disclosed is an ink cartridge for a printer, comprising a body having an opened surface and a predetermined shape to receive ink therein; a cover coupled with the body to define a desired space; and a chamber instrument comprising a filling chamber having a space for receiving a part of the ink in the body, a discharging chamber connected with the filling chamber, an ink transferring channel for moving the ink received in the filling chamber to the discharging chamber, an air guiding hold for guiding air to an inside of the cartridge, an air suction valve for selectively passing the guided air and a pressure regulating valve for regulating an internal pressure of the body.

7 Claims, 16 Drawing Sheets

INK CARTRIDGE FOR PRINTER

TECHNICAL FIELD

The present invention relates to an ink cartridge for a printer, and more particularly, to an ink cartridge for a printer, in which a body for storing ink is enlarged and an internal pressure of the ink cartridge is maintained constantly, thereby obtaining a high printing quality.

BACKGROUND ART

Generally, a printer is to output various documents and pictures prepared by a computer, and classified into a dot printer, an inject printer and a laser beam printer and so on. As shown in FIG. 1, the inkjet printer includes a cartridge carrier 110 which is movably disposed at an inner side of the printer 100, a body for removably installing an ink cartridge 120 which is filled with ink, and a needle 111 for sucking the ink in the ink cartridge 120. Therefore, the ink is transferred through the needle 111 to a head 112 for ejecting the ink.

The ink cartridge may have various shapes and structures according to its kind, but generally has a predetermined shape so as to be installed in the printer. As shown in FIG. 2, the ink cartridge forms an internal body by coupling a cover 230 and a body 200 in which a receiving portion 201 is formed. A sponge 210 impregnated with the ink is disposed in the body 200. And at a lower surface of the body 200, there is formed a discharging portion 220 through which the impregnated ink is discharged. A through-hole 203 is formed at a desired portion of the cover 230 so as to supply external air to the inside of the body 200.

Therefore, when the printer 100 is operated, the cartridge carrier 110 is moved by an electric signal of a controlling part, the ink is ejected from the head 112 to print the documents and pictures. The ink in the receiving portion 201 is continuously supplied to the head 112 through the ink discharging portion 220 and the ink suction needle 111 so as to be capable of performing a continuous printing process.

However, in the conventional ink cartridge, since the sponge 210 impregnated with the ink is provided in the body 200, a body for storing the ink is reduced. Further, since an assembling process for installing the sponge 210 in the body 200 is required additionally, there is another problem that a fabricating cost is increased.

In order to solve the problems, there was proposed a solution that removes the sponge 210 from the inside of the body 200. In this case, since it is difficult to maintain an internal pressure of the cartridge constantly, there is a problem that the ink is leaked to the head, thereby deteriorating the printing quality of a printed material.

In addition, the ink filled in the ink suction needle 111 or the head 112 may be flowed backward by a change of the internal pressure of the cartridge body 200 due to a change of an internal temperature of the cartridge. Thus, there is other problem that the ink is not ejected to the head although the electric signal is input from the controlling part, or the ink is flowed to the head, thereby deteriorating the printing quality of a printed material.

DISCLOSURE

Technical Problem

An object of the present invention is to provide an ink cartridge for a printer, which is provided with a pressure regulating valve communicated with an air suction valve to offset the change of the internal pressure of the cartridge, thereby solving the problem that the ink is not ejected to the head although the electric signal is input from the controlling part or the ink is flowed to the head, thereby preventing the deterioration of the printing quality of a printed material, which is caused by the change of the internal pressure of the cartridge body 200 due to the change of an internal temperature of the cartridge.

Further, another object of the present invention is to provide an ink cartridge for a printer, which includes a cover with a pressure regulating part disposed at an upper side of the cartridge so as to maintain the internal pressure of the cartridge constantly and also supply the ink stably and rapidly, thereby obtaining a high printing quality and reducing the fabricating cost of the cartridge.

Technical Solution

To achieve these objects of the present invention, there is provided an ink cartridge for a printer, comprising a body having an opened surface and a desired size to receive ink therein; a cover coupled with the body to define a desired body; and a chamber instrument comprising a filling chamber having a space for receiving a part of the ink in the body, a discharging chamber connected with the filling chamber, an ink transferring channel for moving the ink received in the filling chamber to the discharging chamber, an air guiding hole for guiding air to an inside of the cartridge, an air suction valve for selectively passing the guided air and a pressure regulating valve for regulating an internal pressure of the body.

Preferably, the air suction valve and the air regulating valve comprises elastically a check valve which is opened only in one direction.

Preferably, the body is divided into a plurality of spaces by at least partition, and the chamber instruments are arranged in parallel within the spaces.

ADVANTAGEOUS EFFECTS

According to the present invention, although the sponge is removed from the body, it is possible to constantly maintain the internal pressure of the cartridge as well as to increase an internal space. Further, since there is provided the air suction valve for sucking the air according to the internal pressure of the cartridge, it is possible to previously prevent the ink from being flowed to the outside.

In addition, since the present invention provides the pressure regulating valve or portion for regulating a difference between the internal pressure and the external pressure of the body, it is possible to prevent the generation of excessive positive or negative pressure in the cartridge.

Furthermore, since the pressure regulating valve or part is provided at each body of the cartridge, although the plurality of bodies are used to provide multiple color, it is possible to secure the stable process of discharging the ink and to maintain a high printing quality.

DESCRIPTION OF DRAWINGS

The above and other objects, features and advantages of the present invention will become apparent from the following description of preferred embodiments given in conjunction with the accompanying drawings, in which.

DETAILED DESCRIPTION OF THE MAIN ELEMENTS

Figure 1:
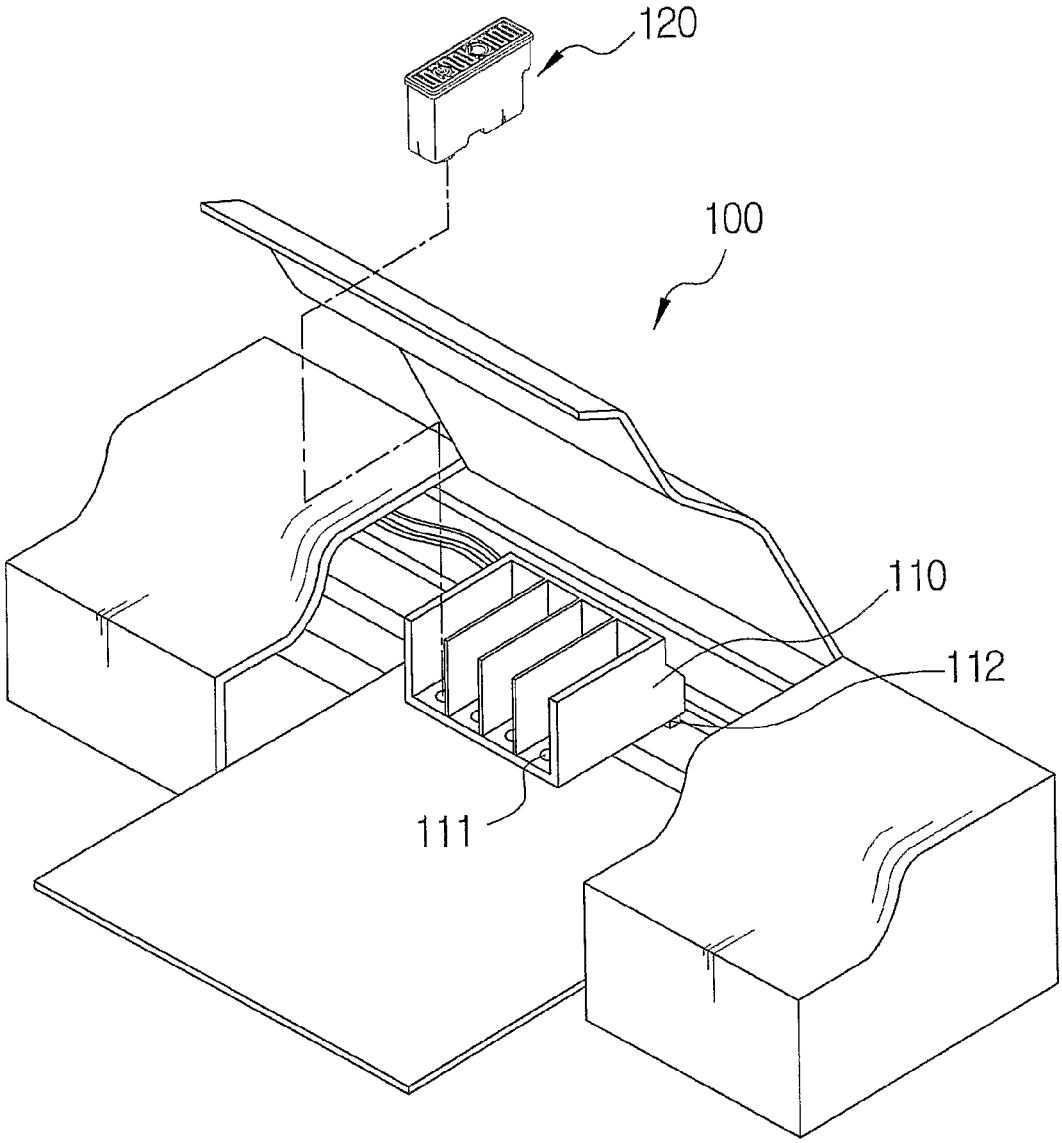
FIG. 1 is a perspective view illustrating a general printer.
Figure 2:
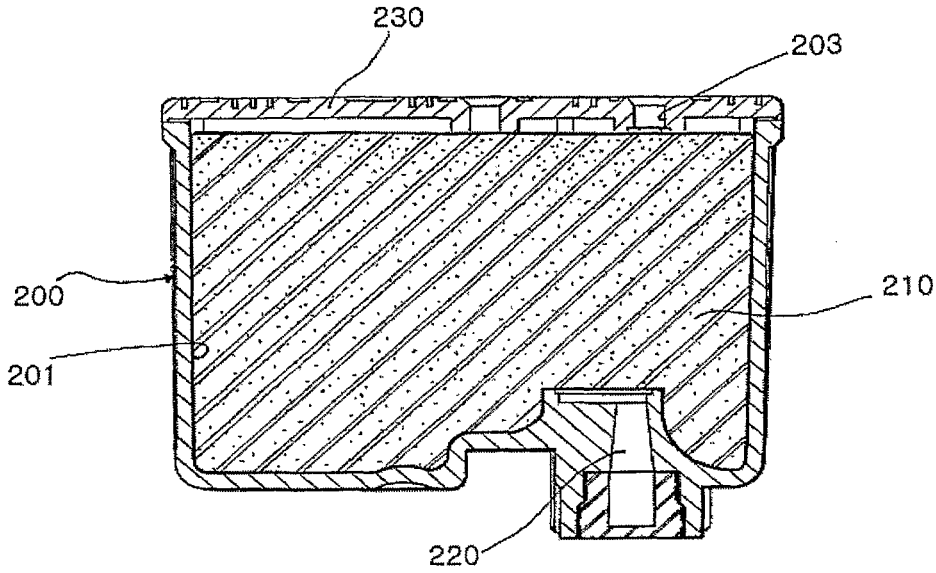
FIG. 2 is a cross-sectional view of a conventional ink cartridge.

300, 400, 500: body 301, 401: ink discharging port

302: ink introducing groove 310, 410: chamber instrument

311, 411: filling chamber 312, 412: discharging chamber

313, 413: ink transferring channel 314, 414: air guiding hole

315, 415: air suction valve 316: pressure regulating valve

317, 417: air inducing guide 318: ink discharging guide

319, 419: ink inlet port 320, 420, 520: cover

321, 421, 521: air inducing port 322, 422, 522: ink filling port

325: partition

424: cover film 423: ink filling port cap

430, 530: pressure regulating part 431, 531: blocking film

432, 532: air floating hole

Best Mode

Hereinafter, the embodiments of the present invention will be described in detail with reference to accompanying drawings.

Figure 3:
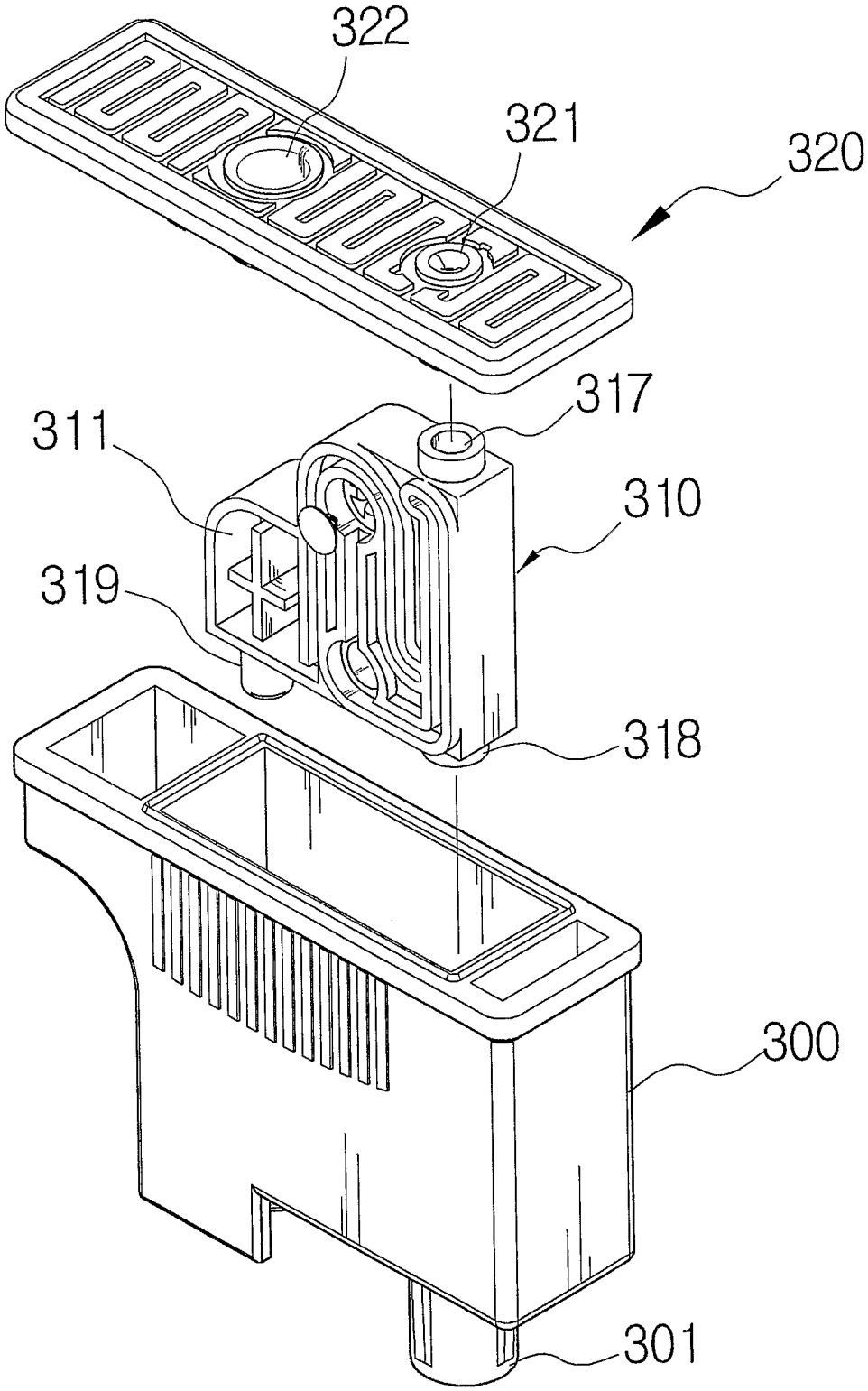
FIG. 3 is an exploded perspective view illustrating an ink cartridge according to a first embodiment of the present invention.
Figure 4:
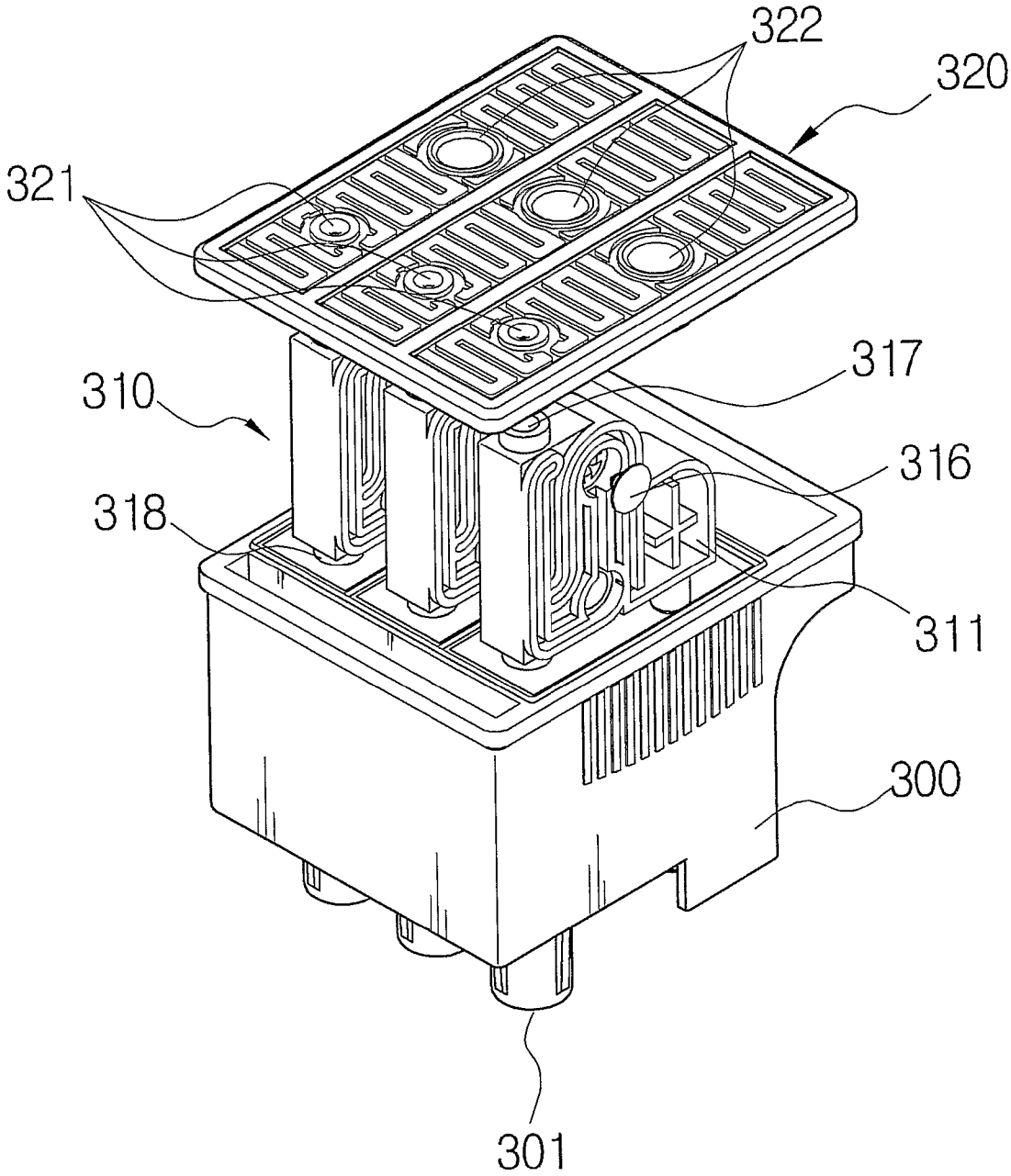
FIG. 4 is an exploded perspective view illustrating the ink cartridge according to the first embodiment of the present invention.
Figure 5:
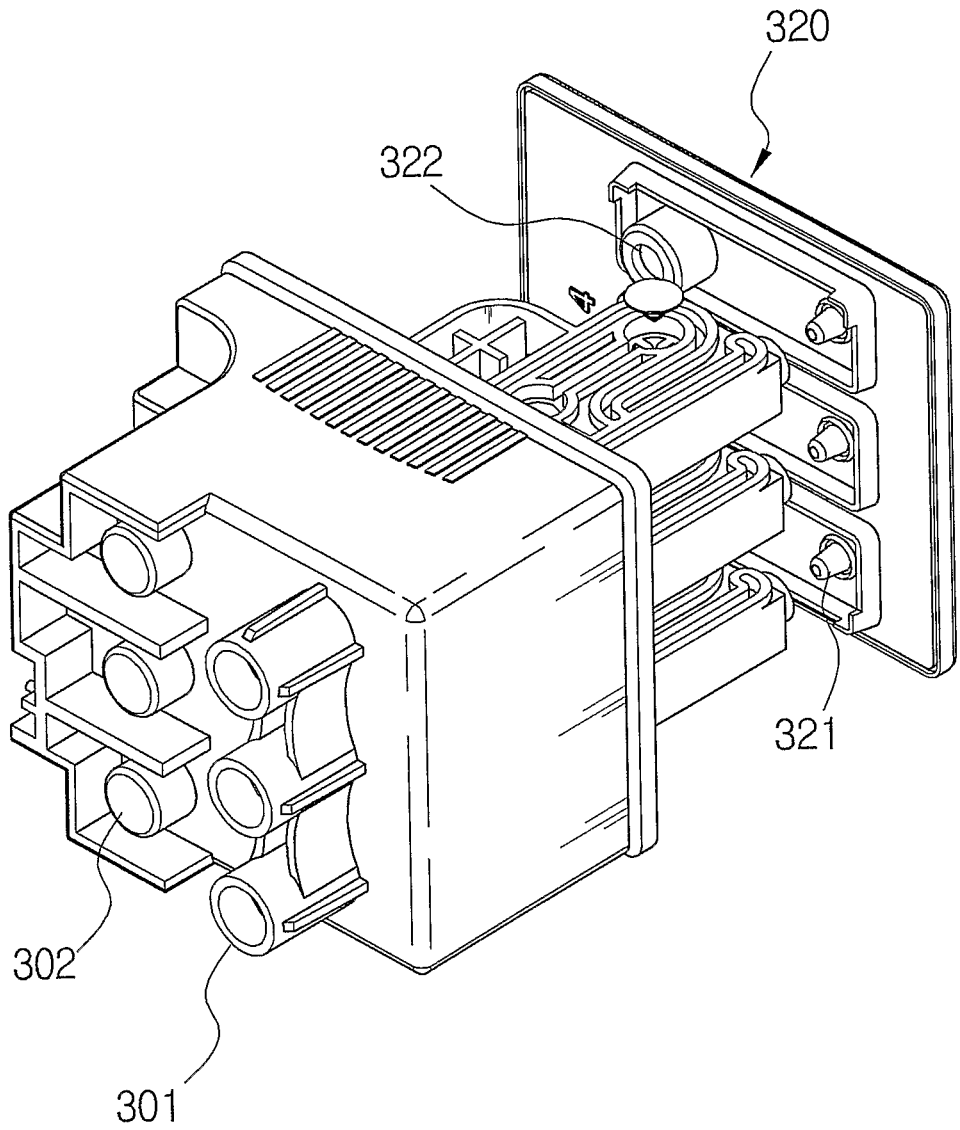
FIG. 5 is a rear view illustrating the ink cartridge according to the first embodiment of the present invention.
Figure 6:
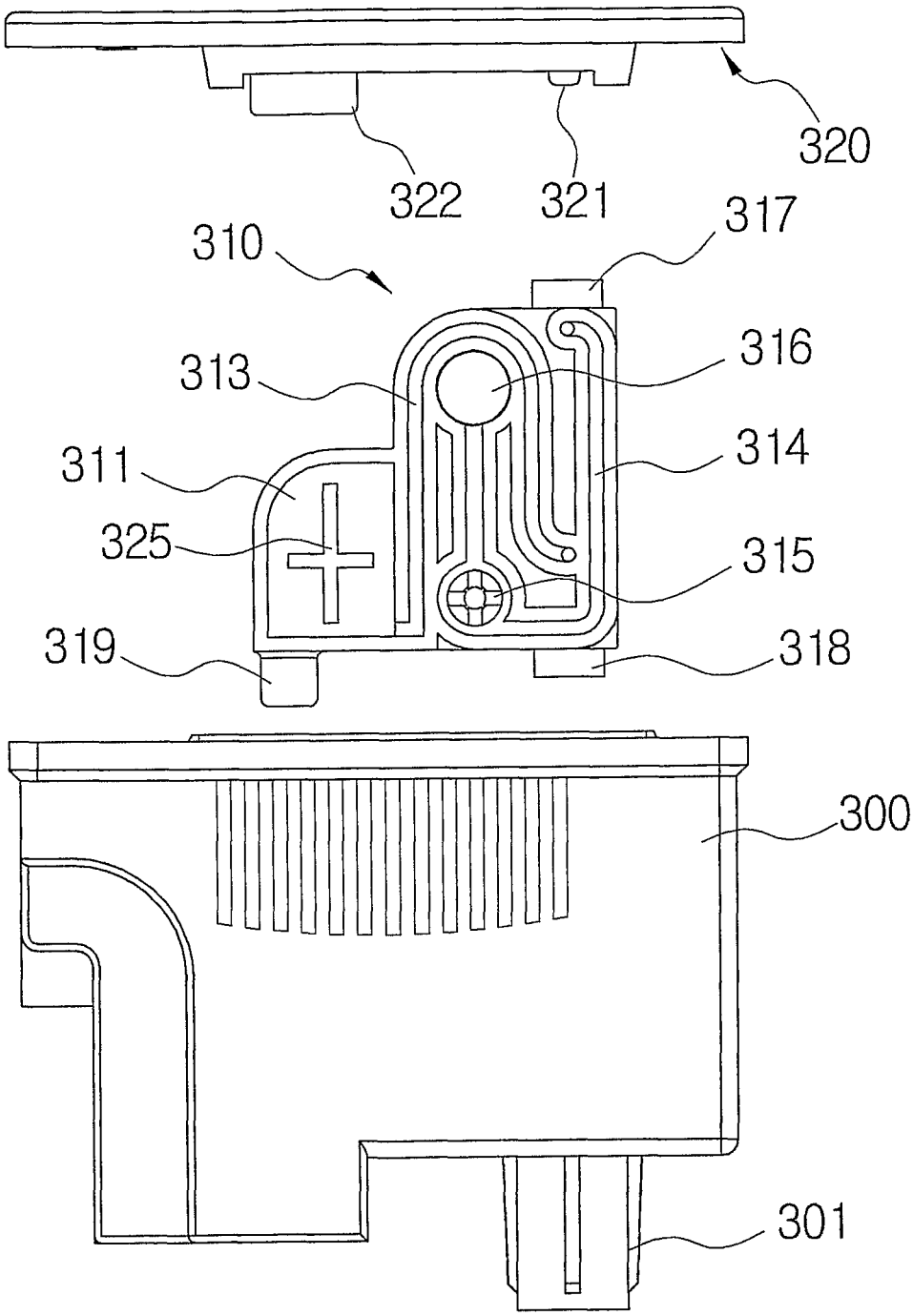
FIG. 6 is a front view illustrating the ink cartridge according to the first embodiment of the present invention.
Figure 7:
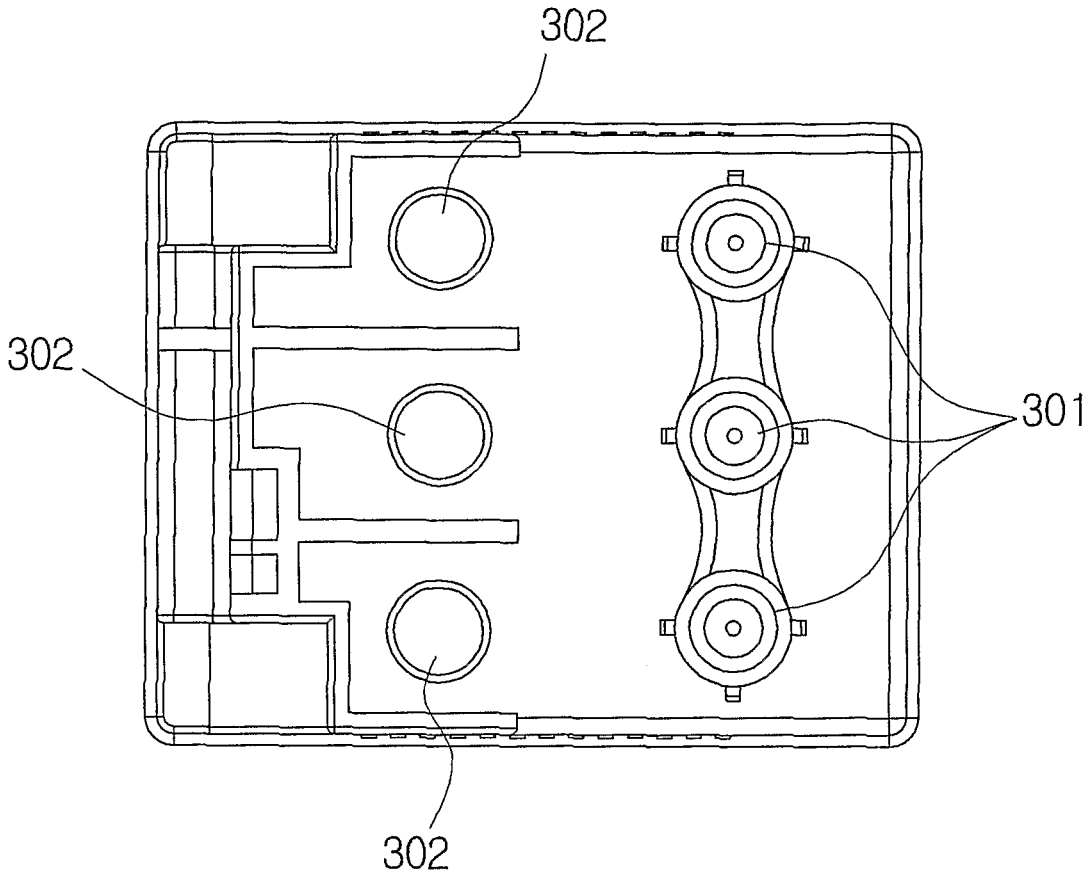
FIG. 7 is a bottom view illustrating the ink cartridge according to the first embodiment of the present invention.
Figure 8:
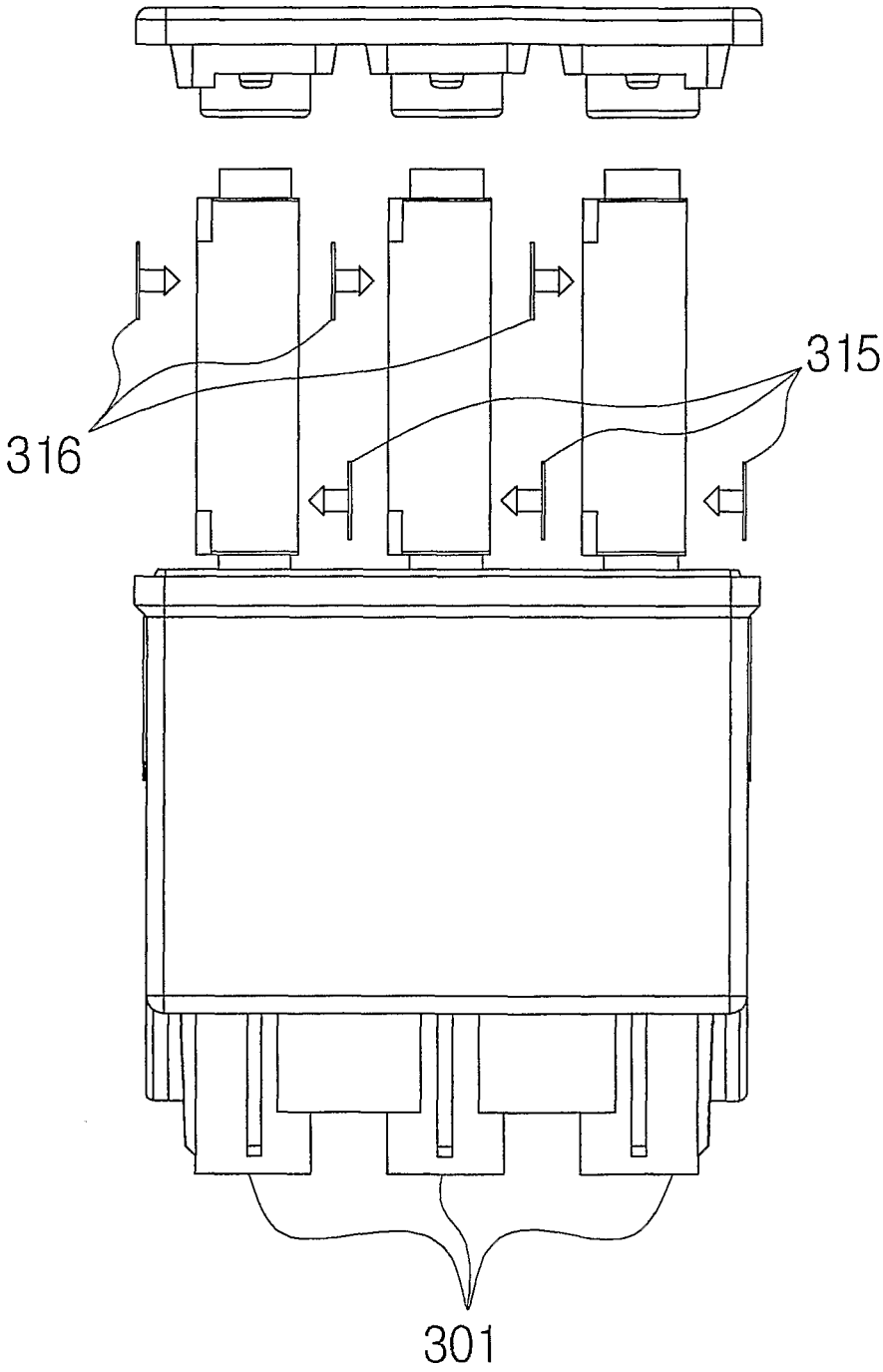
FIG. 8 is a side view illustrating the ink cartridge according to the first embodiment of the present invention.
Figure 9:
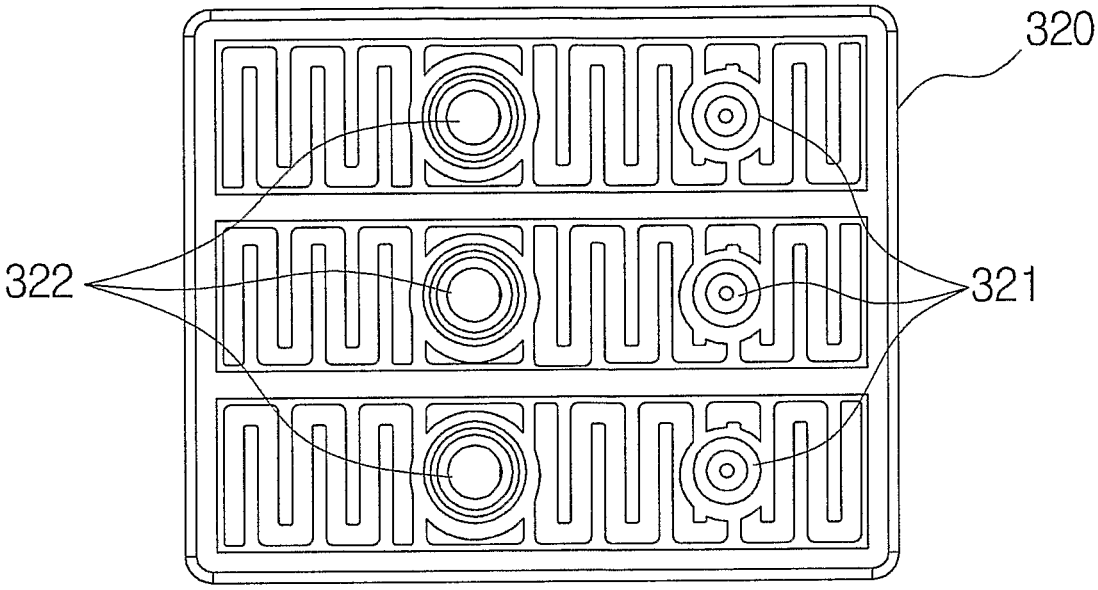
FIG. 9 is a top view illustrating the ink cartridge according to the first embodiment of the present invention.
Figure 10:
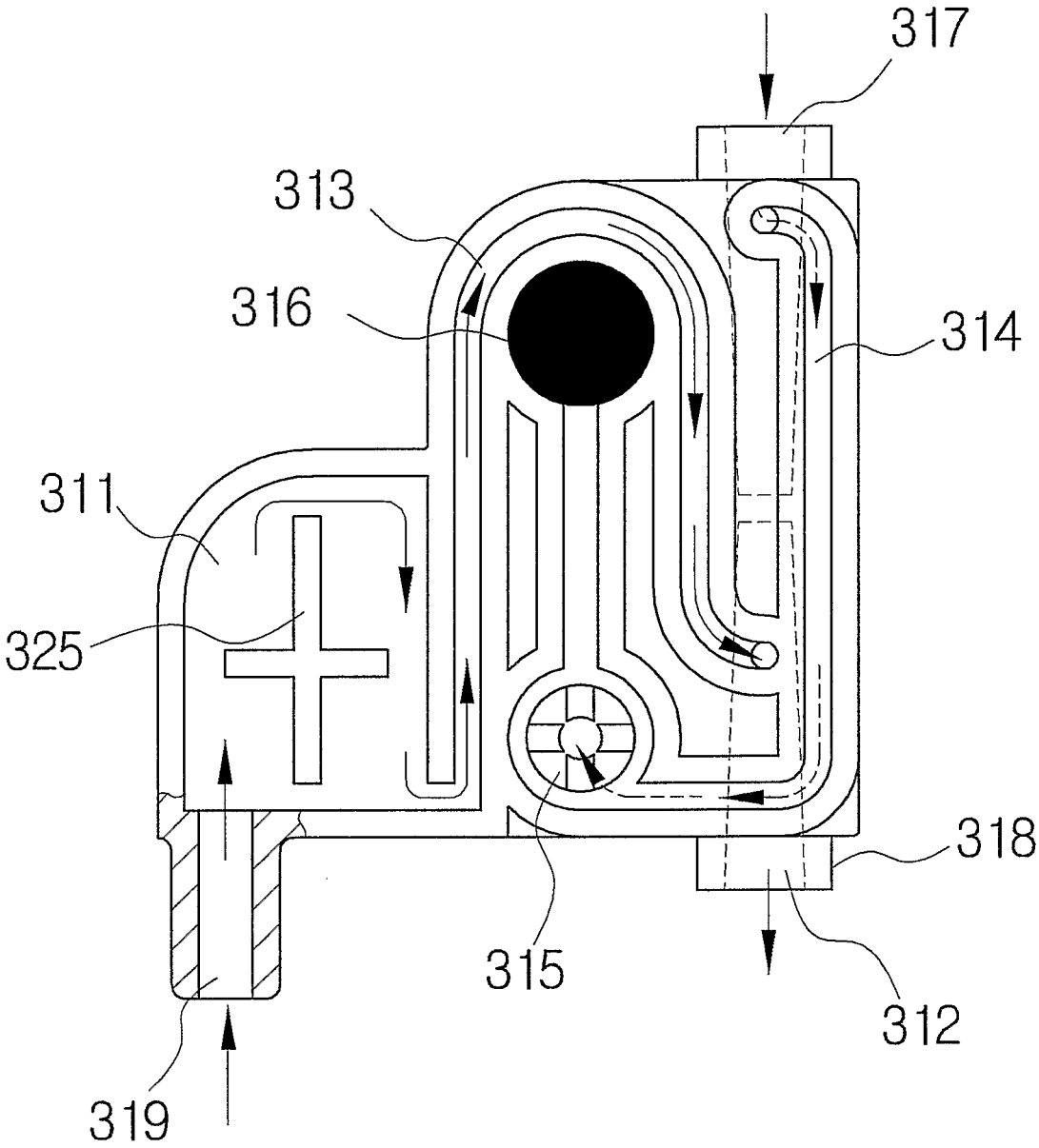
FIG. 10 is enlarged partial view illustrating the ink cartridge according to the first embodiment of the present invention.
Figure 11:
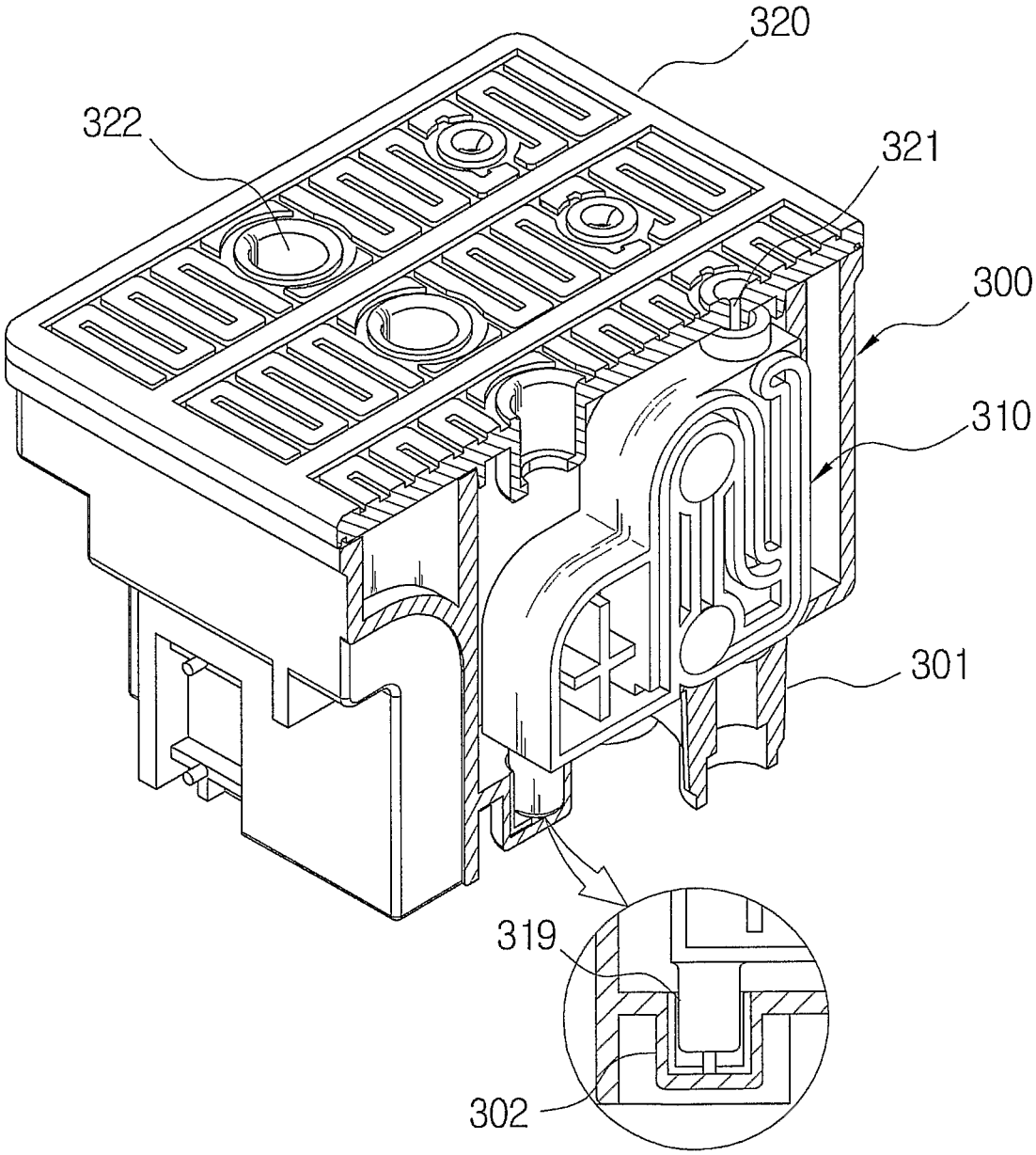
FIG. 11 is a cross-sectional view illustrating the ink cartridge according to the first embodiment of the present invention.

FIGS. 3 to 11 are views illustrating an ink cartridge according to a first embodiment of the present invention, FIGS. 3 and 4 are perspective views, FIG. 5 is a rear view, FIGS. 6 to 9 are a front view, a bottom view, a side view and a top view, respectively, FIG. 10 is an enlarged partial view and FIG. 11 is a cross-sectional view. Of course, various sizes and shapes can be applied to the cartridge of the present invention.

Referring to FIGS. 3 to 11, the ink cartridge according to an embodiment of the present invention may have predetermined shape one or a plurality of chamber instruments which are arranged side by side in a body 300. At an upper side of the chamber instrument 310, there may be formed an air inducing guide 317. The air inducing guide 317 is communicated with an air inducing port 321 which may be formed at a cover 320. At a lower side of the chamber instrument 310, there is formed a discharging chamber 312. The discharging chamber 312 is coupled to the body 300 to be communicated through the ink discharging guide 318 with an ink discharging port 301 which is formed at a lower side of the body. Meanwhile, the chamber instrument 310 includes a body defined by a blocking film and an ink inlet port 319 formed at the lower side thereof to introduce the ink filled in the body 300 to a filling chamber 311. The filling chamber 311 and the discharging chamber 312 are communicated with each other through an ink transferring channel 313 formed at an outer surface of the chamber instrument 310. The filling chamber 311 functions to disperse a whole weight of the ink in the cartridge and reduce a load applied to a printer head part. An end of the ink transferring channel 313 is connected with a middle portion of the discharging chamber 312. Alternatively, if air is introduced into the discharging chamber 312, this structure makes the air stayed at an upper portion of the discharging chamber 312, thereby preventing deterioration of a printing quality which caused by the air supplied to the printer head. Therefore, the end of the ink transferring channel 313 may be formed at a lower end of the discharging chamber 312 so that more air can be stayed at the upper portion of the discharging chamber 312.

Further, the air introduced through the air inducing port 321 of the cover 320 is flowed into the chamber instrument 310 through the air inducing guide 317 formed at the upper side of chamber instrument 310 and then finally flowed into the cartridge through an air guiding hole 314 and an air suction valve 315. Preferably, the air suction valve 315 includes a check valve, which is opened only in one direction, so as to suck the external air while preventing the ink from being discharged. The air suction valve 315 is operated when a cover film (not shown) attached to an outer surface of the cover 320 is removed.

According to the present invention, a pressure regulating valve 316 which is opened only in one direction is provided at one side surface of the chamber instrument 310 so as to adjust an internal pressure of the ink cartridge. Preferably, the pressure regulating valve 316 includes the check valve which is flexibly operated according to a change of the internal pressure of the ink cartridge. In an example, the check value for the air suction valve 315 and the pressure regulating valve 316 may be formed into a thumbtack. The pressure regulating valve 316 is opened only in one direction from an outside of the chamber instrument 310 toward an inside thereof, and thus the air as much as an amount increased through the valve can be discharged to the outside when the internal pressure of the cartridge is increased or an internal volume of the cartridge is expanded due to an external cause like an increase in temperature.

The discharged air is exhausted to the outside through the air guiding hole 314. Even in case that the pressure regulating valve 316 is placed at a higher position than an ink level in the cartridge, since the air air guiding hole 314 is extended to the high position, the pressure regulating valve 316 prevents the ink in the cartridge from being flowed backward. Further, it is preferred that the pressure regulating valve 316 has an opening direction opposite to that of the air suction valve 315.

Meanwhile, an ink introducing groove 302 is formed at the lower side of the body 300. When the ink level remained in the cartridge is lower than the ink inlet port 319, this structure prevents the air in the body 300 from being introduced through the ink inlet port 319 to the filling chamber 311 and also minimizes a residual amount of ink in the cartridge.

Hereinafter, an operation according to the embodiment of the present will be described.

First of all, if the ink is injected into the cartridge through an ink filling port 422 of a cover 420 in a status that an ink discharging port 401 formed at the lower side of a body 400 is sealed, an ink level in the body 400 is increased and, at the same time, the ink is introduced through an ink inlet port 419 into a filling chamber 411 of the chamber instrument 410 received in the body 400. The ink introduced in the filling chamber 411 is moved to a discharging chamber 412 along an ink transferring channel 413. If the ink injection process is completed, the ink filling port 422 is closed by using like a rubber stopper, and an air inducing port 421 of the cover 420 is closed by using like a blocking film.

When using the ink cartridge, the blocking film (not shown) which closes the air inducing port 421 of the cover 420 is removed and than the ink cartridge is installed in a cartridge carrier 110. The ink discharging port 401 formed at the ink cartridge is coupled with an ink suction needle 111 disposed at the cartridge carrier 110.

In this status, if the printer 100 is operated, a sucking force is applied to the ink suction needle 111 and the ink stored in the discharging chamber 412 is moved to the ink discharging port 401 through the ink discharging guide 318 so as to be supplied to the printer. If the ink is discharged, the internal pressure is reduced. Therefore, the external air is introduced through the air inducing port 421 of the cover 420, and the air is introduced in the cartridge while opening an air suction valve 415 through an air guiding hole 414.

Meanwhile, if a temperature of the atmosphere is changed according to a place where the ink cartridge is used, there is generated a difference with an internal temperature and also a difference between the internal pressure and the external pressure of cartridge, and thus an excessive negative or positive pressure is generated in the cartridge. If the excessive positive pressure is generated in the cartridge, it is apprehended that an excessive amount of ink is discharged through the ink discharging port 301. And if the excessive negative pressure is generated in the cartridge, it is apprehended that the ink is not discharged properly. In these cases, the pressure regulating valve 316 is rapidly opened or closed in response to the difference between the internal pressure and the external pressure of cartridge so that the pressure difference is offset smoothly so as to maintain a balance of pressure, thereby properly discharging the ink to the printer head.

Meanwhile, according to the present invention, a plurality of chamber instruments as well as the single chamber 310 may be installed in the body 300. The plurality of chamber instruments 310 are respectively divided by a partition so as to receive different color inks. And on an upper surface of the body 300, there is provided the cover 420 in which each air inducing port is formed to be communicated with the air inducing guide 317 of the chamber instrument 310.

Furthermore, at least bodies 300 in which the chamber instrument 310 is received may be arranged in parallel so as to form the ink cartridge.

Figure 12:
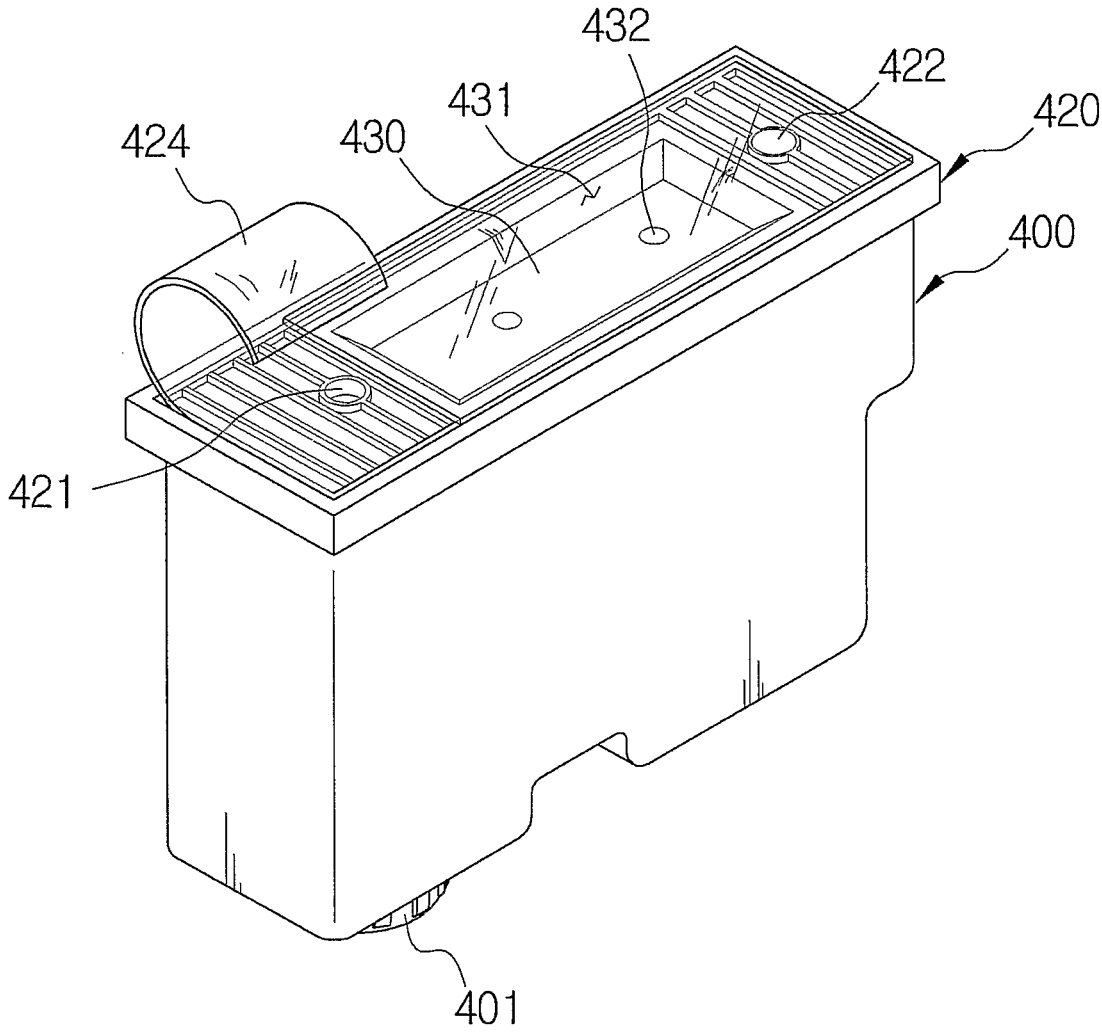
FIG. 12 is a perspective view illustrating an ink cartridge according to a second embodiment of the present invention.
Figure 13:
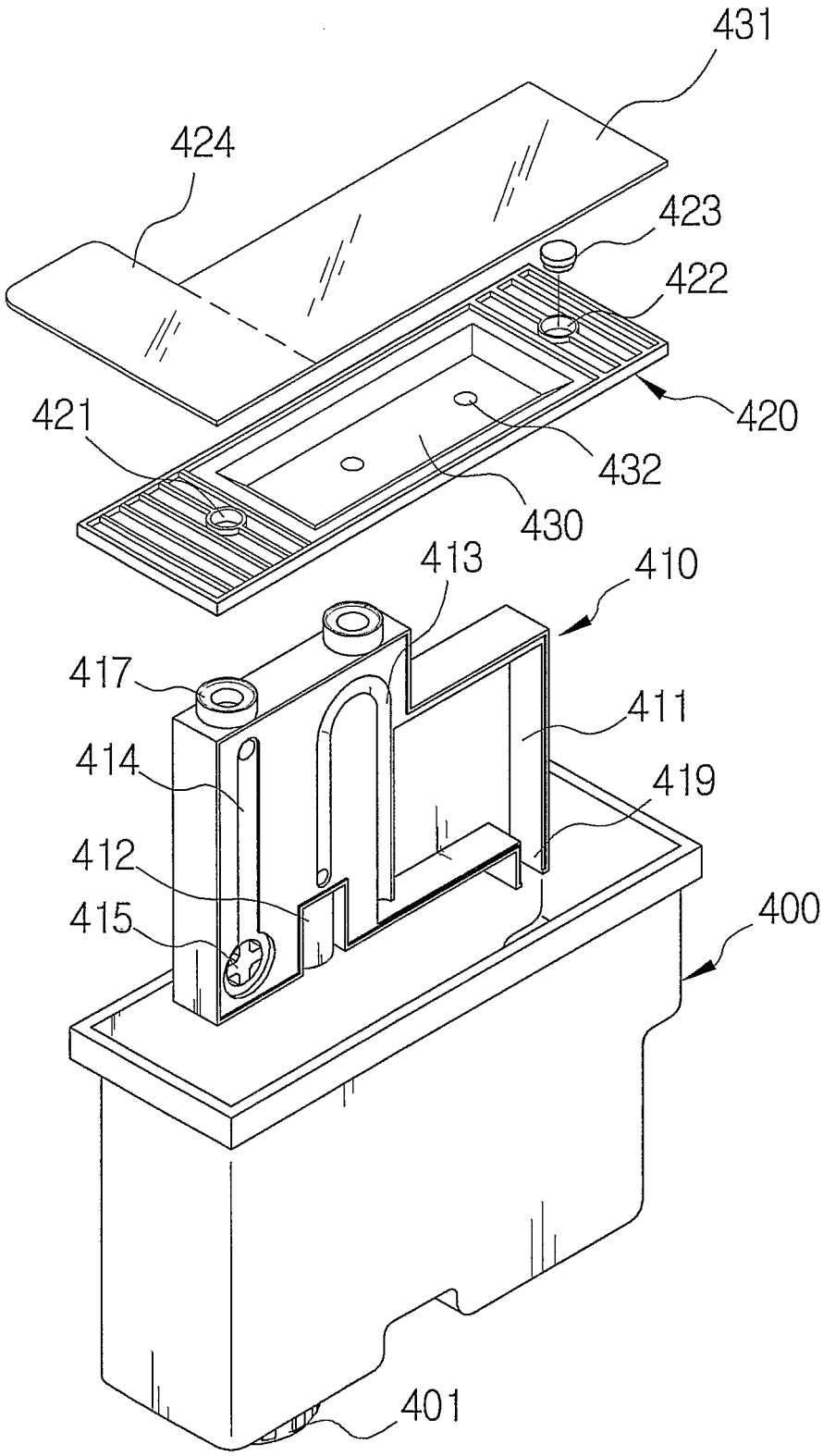
FIG. 13 is an exploded view illustrating the ink cartridge according to the second embodiment of the present invention.
Figure 14:
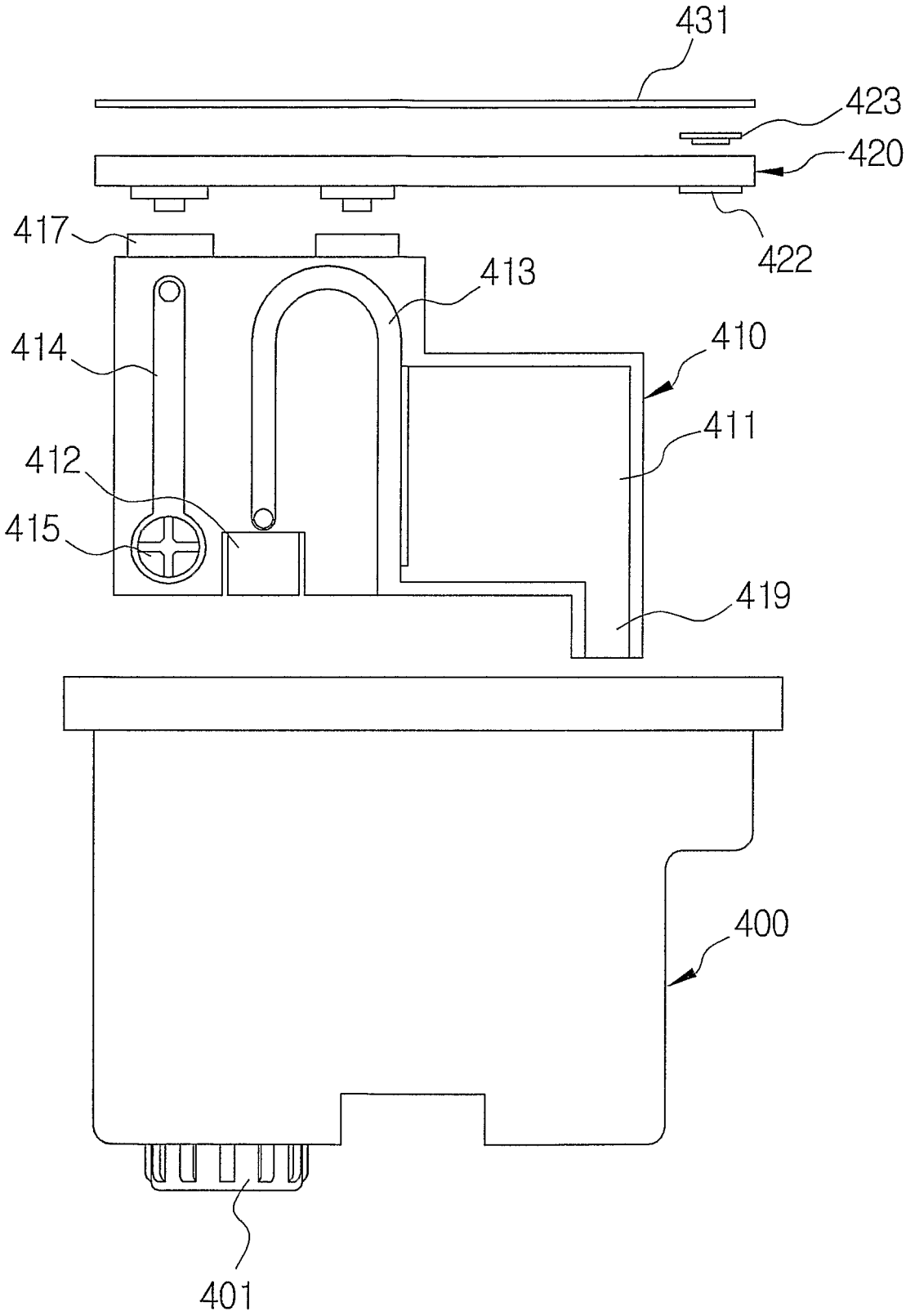
FIG. 14 is a front view illustrating the ink cartridge according to the second embodiment of the present invention.
Figure 15:
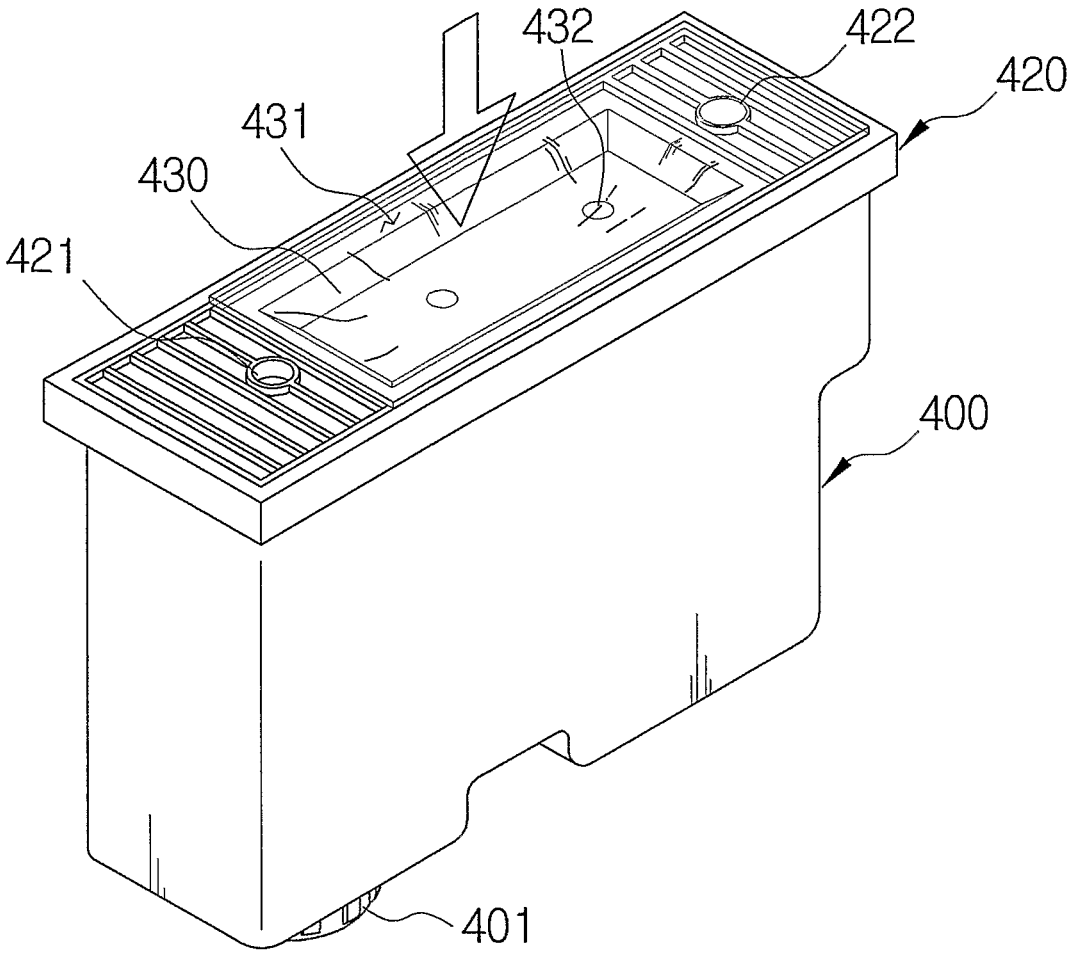
FIG. 15 is a view explaining a function of an isolation film according to the second embodiment of the present invention.
Figure 16:
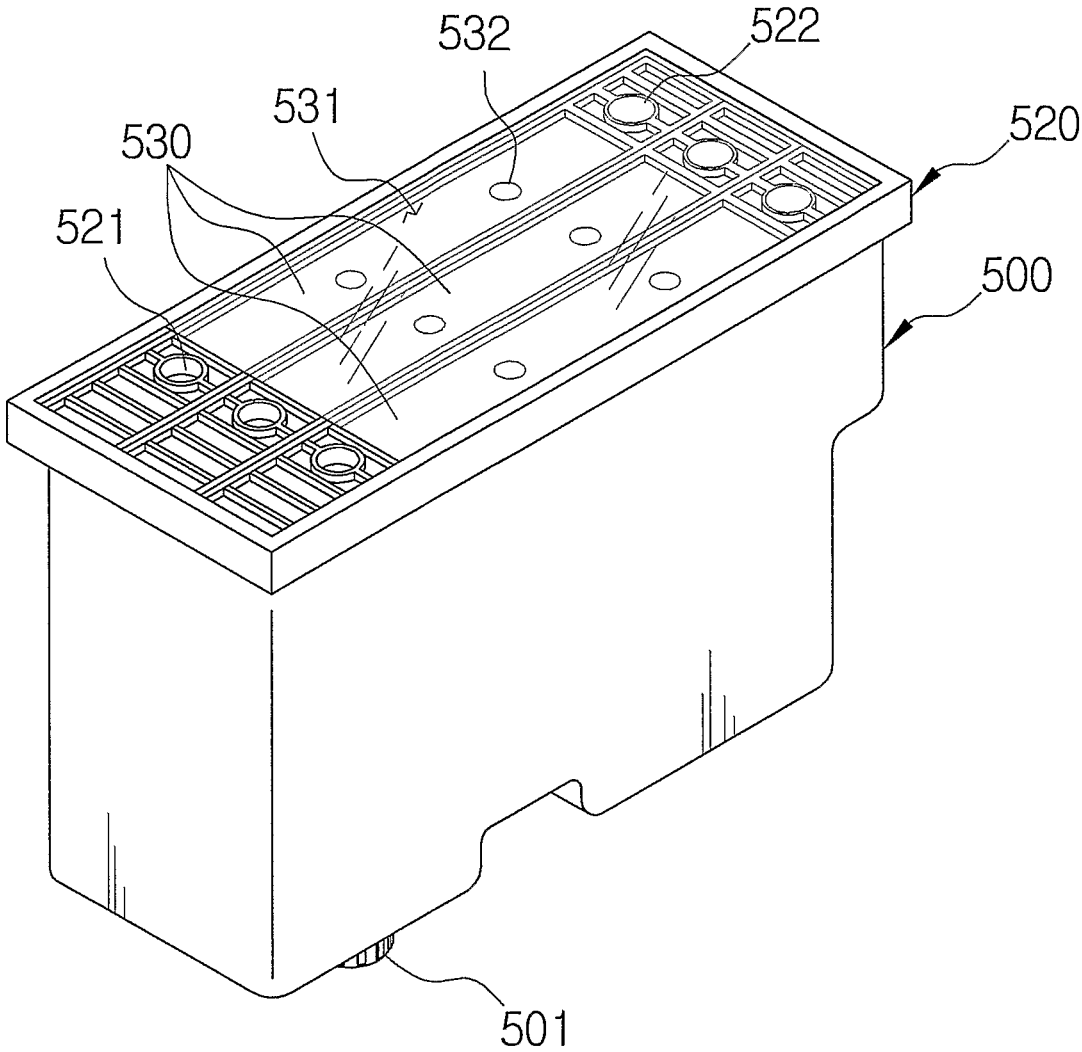
FIG. 16 is a perspective view illustrating a construction in which a plurality of cartridge bodies are installed in a case.

FIGS. 12 to 16 are views illustrating the ink cartridge according to a second embodiment of the present invention; FIG. 12 is a perspective view, FIG. 13 is an exploded view, FIG. 14 is a front view, FIG. 15 a view explaining a function of blocking film according to the second embodiment of the present invention, and FIG. 16 is a perspective view illustrating a construction in which a plurality of cartridge bodies are installed in a case. Of course, various sizes and shapes can be applied to the cartridge of the present invention.

As shown in drawings, the ink cartridge according to the second embodiment of the present invention includes the chamber instrument 410 having a predetermined size, the filling chamber 411 for storing the ink and the discharging chamber 412 for discharging the ink. The filling chamber 411 and the discharging chamber 412 are formed at one side of the chamber instrument 410 so as to be communicated with each other through the ink transferring channel 413.

In the second embodiment of the present invention, a pressure regulating portion 430 of the cover 420 has a function corresponding to the pressure regulating valve 316 of the first embodiment. In the cover 420, the air inducing port 421 communicated with the air inducing guide 417 of the chamber instrument 410 is formed at one side thereof, and the pressure regulating portion 430 having a plurality of air floating hole 432 is formed at a middle portion thereof, and the ink filling portion 422 is formed at the other side thereof.

If a temperature of the atmosphere is changed according to a place where the ink cartridge is used, there is generated a difference with an internal temperature and also a difference between the internal pressure and the external pressure of cartridge, and thus an excessive negative or positive pressure is generated in the cartridge. In case that the excessive negative or positive pressure is generated in the cartridge, as shown in FIG. 11, a blocking film 431 attached to the pressure regulating portion 430 is elastically expanded or contacted in response to the difference between the internal pressure and the external pressure of cartridge so that the pressure difference is offset smoothly so as to maintain a balance of pressure, thereby properly discharging the ink to the printer head.

Meanwhile, in the second embodiment of the present invention, as shown in FIG. 16, a plurality of chamber instruments as well as the single chamber may be installed in the body 300. The plurality of chamber instruments 510 are respectively divided by a partition wall so as to receive different color inks. And on an upper surface of the body 500, there is provided the cover 520 in which each air inducing port 521 is formed to be communicated with the air inducing guide 517 of the chamber instrument 510.

Furthermore, at least bodies 500 in which the chamber instrument 510 is received may be arranged in parallel so as to form the ink cartridge.

And the description of other constructions is the same as that in the first embodiment.

[Industrial Applicability]

According to the present invention, although the sponge is removed from the body, it is possible to constantly maintain the internal pressure of the cartridge as well as to increase an internal space. Further, since there is provided the air suction valve for sucking the air according to the internal pressure of the cartridge, it is possible to previously prevent the ink from being flowed to the outside.

In addition, since the present invention provides the pressure regulating valve or portion for regulating a difference between the internal pressure and the external pressure of the body, it is possible to prevent the generation of excessive positive or negative pressure in the cartridge.

Furthermore, since the pressure regulating valve or part is provided at each body of the cartridge, although the plurality of bodies are used to provide multiple color, it is possible to secure the stable process of discharging the ink and to maintain a high printing quality.

The invention claimed is:

1. An ink cartridge for a printer, comprising:

a body having an opened surface and a predetermined shape to receive ink therein;

a cover coupled with the body to define a desired space and provided with an ink filling port for injecting the ink into the body and an air inducing port that is in communication with the body so as to introduce air into the body or discharge the air from the body;

a chamber instrument provided inside the body; and wherein the chamber instrument comprises a filling chamber having a space for receiving a part of the ink in the body, a discharging chamber connected with the filling chamber, an ink transferring channel for moving the ink received in the filling chamber to the discharging chamber, an air guiding hole for guiding air to an inside of the cartridge, an air suction valve that is in communication with the air guiding hole to allow the air introduced through the air guiding hole to enter and leave a space between the chamber instrument and the body and includes a check valve allowing air to float into an inner portion of the cartridge through the air guiding hole, and a pressure regulating valve that is in communication with the air guiding hole to discharge air in the body through the air guiding hole, thereby controlling an internal pressure of the body, and includes a check valve allowing air to be exhausted to an outside through the air guiding hole.

2. The ink cartridge according to claim 1, wherein the pressure regulating valve has an opening direction opposite to that of the air suction valve.

3. The ink cartridge according to claim 1, wherein the chamber instrument has a surface which forming a desired space by a blocking film.

4. The ink cartridge according to claim 1, wherein the chamber instrument is formed with an ink inlet port formed at a lower side thereof so that the ink in the body can be introduced into the filling chamber.

5. The ink cartridge according to claim 4, wherein the body further comprises an ink introducing groove protruded from the lower side thereof to the outside so as to receive the ink inlet port.

6. The ink cartridge according to claim 1, wherein an end of the ink transferring channel is placed at a middle portion of the discharging chamber.

7. The ink cartridge according to any one of claims 1, 2, and 3 to 6, wherein the body is divided into a plurality of spaces by at least partition, and the chamber instruments are arranged in parallel within the spaces.

* * * * *

UNITED STATES PATENT AND TRADEMARK OFFICE

CERTIFICATE OF CORRECTION

PATENT NO. : 8,425,021 B2
APPLICATION NO. : 12/093812
DATED : April 23, 2013
INVENTOR(S) : Chung et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1117 days.

Signed and Sealed this
Eighth Day of September, 2015

Michelle K. Lee

Michelle K. Lee
*Director of the United States Patent and Trademark Office*